US010072386B1

(12) United States Patent
Lehtola et al.

(10) Patent No.: US 10,072,386 B1
(45) Date of Patent: Sep. 11, 2018

(54) VIBRATION SYSTEM

(71) Applicant: Caterpillar Paving Products Inc., Brooklyn Park, MN (US)

(72) Inventors: Joseph Alan Lehtola, Buffalo, MN (US); Nicholas Alan Oetken, Brooklyn Park, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 15/592,540

(22) Filed: May 11, 2017

(51) Int. Cl.
*E01C 19/28* (2006.01)
*B06B 1/18* (2006.01)

(52) U.S. Cl.
CPC ..... *E01C 19/286* (2013.01); *B06B 1/186* (2013.01); *E01C 19/282* (2013.01)

(58) Field of Classification Search
CPC ..... E01C 19/282; E01C 19/286; B06B 1/186
USPC ..... 404/117, 113
See application file for complete search history.

(56) References Cited

U.S. PATENT DOCUMENTS 3,670,631 A * 6/1972 Gaylor ..... B06B 1/162 404/117
5,248,216 A 9/1993 Vural
5,716,162 A 2/1998 Hodgson et al.
6,516,679 B2 2/2003 Yates et al.
7,805,865 B2 10/2010 Paske
2006/0147265 A1* 7/2006 Fluent ..... B06B 1/166 404/117
2009/0103980 A1* 4/2009 Greschner ..... E01C 19/286 404/117
2014/0161529 A1* 6/2014 Darscheid ..... E01C 19/38 404/84.05

FOREIGN PATENT DOCUMENTS

DE 102014226373 6/2016
DE 202016103865 9/2016

* cited by examiner

*Primary Examiner* — Raymond W Addie
(74) *Attorney, Agent, or Firm* — Derek J. Somogy

(57) ABSTRACT

A vibration system for a compactor drum including a central support structure fixedly mounted within the compactor drum. The vibration system also includes a first vibratory exciter coupled to the central support structure. The vibration system further includes a second vibratory exciter coupled to the central support structure. The second vibratory exciter is longitudinally spaced apart from the first vibratory exciter. The vibration system includes a stabilizer element coupled to, and extending between, the first and second vibratory exciters. The stabilizer element is parallel to the central support structure.

20 Claims, 4 Drawing Sheets

VIBRATION SYSTEM

TECHNICAL FIELD

The present disclosure relates to a vibration system associated with a compaction machine.

BACKGROUND

Compaction machines are used for compacting soil substrates. More particularly, after application of an asphalt layer on a ground surface, the compaction machine is moved over the ground surface in order to achieve a planar ground surface. The compaction machines generally include single or dual vibrating compactor drums. The compactor drums generally include a vibration system that transfers vibrations to the ground surface in order to impose compaction forces for leveling the ground surface. The compactor drums may include a conventional vibration system or an oscillatory vibration system, based on application requirements.

During operation of the compaction machine, various components of the compactor drum may be subjected to vibrations. Over a period of time, the vibrations may cause fatigue propagation in one or more compactor drum components thereby causing an early breakdown of the components, which is not desirable.

U.S. Pat. No. 6,516,679 describes an eccentric assembly associated with a vibration compacting machine. The eccentric assembly includes a shaft, first and second eccentric weights, and a member. The first and second eccentric weights are rotatably coupled to the shaft such that they generate vibrations which are transferred to the drum assembly of the vibration compacting machine when the shaft is rotated by a motor.

SUMMARY OF THE DISCLOSURE

In one aspect of the present disclosure, a vibration system for a compactor drum is provided. The vibration system includes a central support structure fixedly mounted within the compactor drum. The vibration system also includes a first vibratory exciter coupled to the central support structure. The vibration system further includes a second vibratory exciter coupled to the central support structure. The second vibratory exciter is longitudinally spaced apart from the first vibratory exciter. The vibration system includes a stabilizer element coupled to, and extending between, the first and second vibratory exciters. The stabilizer element is parallel to the central support structure.

In another aspect of the present disclosure, a compactor drum for a compaction machine is provided. The compactor drum includes a drum shell. The compactor drum also includes a first support plate fixedly mounted within the drum shell. The first support plate is adapted to couple a first side of the compactor drum with a frame of the compaction machine. The compactor drum further includes a second support plate fixedly mounted within the drum shell. The second support plate is spaced apart from the first support plate. The second support plate is adapted to couple a second side of the compactor drum with the frame of the compaction machine. The compactor drum further includes a vibration system for generating vibrations in the compactor drum. The vibration system includes a central support structure fixedly mounted within the drum shell. The vibration system also includes a first vibratory exciter coupled to the central support structure. The vibration system further includes a second vibratory exciter coupled to the central support structure. The second vibratory exciter is longitudinally spaced apart from the first vibratory exciter. The vibration system includes a stabilizer element coupled to, and extending between, the first and second vibratory exciters. The stabilizer element is parallel to the central support structure.

In yet another aspect of the present disclosure, a compaction machine is provided. The compaction machine includes a frame. The compaction machine also includes at least one compactor drum coupled to the compaction machine. The at least one compactor drum includes a drum shell and a vibration system. The vibration system includes a central support structure fixedly mounted within the drum shell. The vibration system also includes a first vibratory exciter coupled to the central support structure. The vibration system further includes a second vibratory exciter coupled to the central support structure. The second vibratory exciter is longitudinally spaced apart from the first vibratory exciter. The vibration system includes a stabilizer element coupled to, and extending between, the first and second vibratory exciters. The stabilizer element is parallel to the central support structure.

Other features and aspects of this disclosure will be apparent from the following description and the accompanying drawings.

DETAILED DESCRIPTION

Reference will now be made in detail to specific aspects or features, examples of which are illustrated in the accompanying drawings. Wherever possible, corresponding or similar reference numbers will be used throughout the drawings to refer to the same or corresponding parts.

Figure 1:
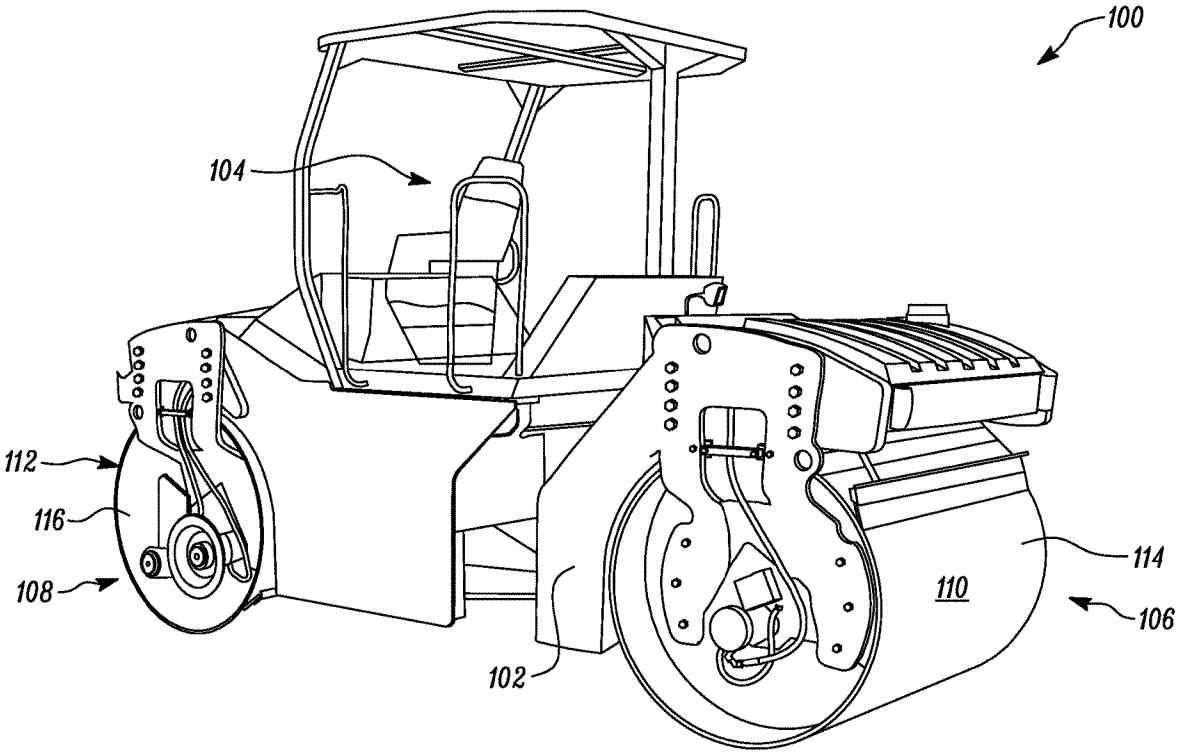
FIG. 1 is a perspective view of a compaction machine, according to one embodiment of the present disclosure.

FIG. 1 illustrates a perspective view of a compaction machine 100, according to one embodiment of the present disclosure. The compaction machine 100 is adapted to move over a ground surface made of asphalt, gravel, and the like, in order to compact it. The compaction machine 100 may be embodied as a manual, autonomous, or semi-autonomous machine, without any limitations. It should be noted that the compaction machine 100 may include any machine that provides compaction of the ground surface or roadway, without any limitations.

The compaction machine 100 includes a frame 102. Further, an engine (not shown) is mounted on the compaction machine 100 for providing propulsion power to the compaction machine 100. The engine may be an internal combustion engine such as a compression ignition diesel engine, but in other embodiments the engine might include a gas turbine engine. An operator cab 104 is mounted on the frame 102. When the compaction machine 100 is embodied as a manual or semi-autonomous machine, an operator of the compaction machine 100 is seated within the operator cab 104 to perform one or more machine operations.

Further, the frame 102 rotatably supports a first compactor drum 106 and a second compactor drum 108. The first and second compactor drums 106, 108 move on the ground surface for compaction of the ground surface. Further, the first and second compactor drums 106, 108 are embodied as a set of ground engaging members that rotate about their respective axes thereby propelling the compaction machine 100 on the ground surface. An outer surface 110, 112 of a drum shell 114, 116 of the respective first and second compactor drums 106, 108 contacts the ground surface, as the compaction machine 100 moves on the ground surface. In other embodiments, it can be contemplated to replace the second compactor drum 108 mounted at a rear end of the compaction machine 100 with a pair of wheels such that the wheels propel the compaction machine 100.

For explanatory purposes, the first compactor drum 106 will now be explained in detail with reference to FIGS. 2, 3, and 4. However, it should be noted that the details of the first compactor drum 106 provided below are equally applicable to the second compactor drum 108, without limiting the scope of the present disclosure.

Figure 2:
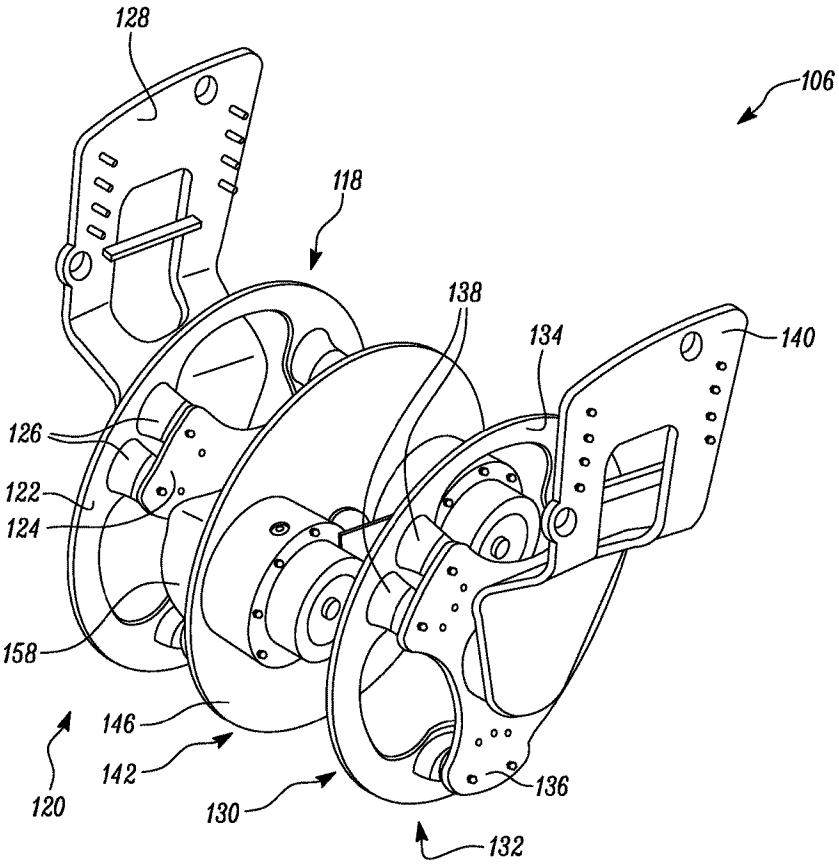
FIG. 2 is a perspective view of components of a compactor drum associated with the compaction machine of FIG. 1, the components are mounted within a drum shell (not shown) of the compactor drum.

Referring to FIG. 2, a perspective view of various compactor drum components mounted within the drum shell 114 is shown. The drum shell 114 has been omitted from this figure for clarity purposes. The first compactor drum 106 includes a first support plate 118. The first support plate 118 is fixedly mounted within the drum shell 114 at a first side 120 of the first compactor drum 106. In one example, the first support plate 118 may be welded to an inner surface of the drum shell 114. Further, the first side 120 of the first compactor drum 106 is defined at a left hand side of the operator seated in the operator cab 104. The first support plate 118 includes a disc-shaped member 122 and a lobe-shaped member 124. A number of damping elements 126, such as springs, are arranged between the disc-shaped member 122 and the lobe-shaped member 124 for damping vibrations generated in the first compactor drum 106.

Further, a drive motor (not shown) and a transmission gear (not shown) are coupled to the first support plate 118. In one example, the drive motor may be embodied as an electric motor, without any limitations. The drive motor and the transmission gear enable the first compactor drum 106 to be rotated and thus the compaction machine 100 to move over the ground surface. The first compactor drum 106 also includes a first support bracket 128. A lower portion of the first support bracket 128 is coupled to the first support plate 118. Whereas, an upper portion of the first support bracket 128 is coupled to the frame 102. Thus, the first support bracket 128 and the first support plate 118 together couple the first side 120 of the first compactor drum 106 with the frame 102.

The first compactor drum 106 also includes a second support plate 130 fixedly mounted within the drum shell 114 at a second side 132 of the first compactor drum 106. The second support plate 130 is spaced apart from the first support plate 118. In one example, the second support plate 130 may be welded to the inner surface of the drum shell 114. Further, the second side 132 of the first compactor drum 106 is defined at a right hand side of the operator seated in the operator cab 104. The second support plate 130 includes a disc-shaped member 134 and a lobe-shaped member 136. A number of damping elements 138, such as springs, are arranged between the disc-shaped member 134 and the lobe-shaped member 136 for damping the vibrations generated in the first compactor drum 106.

The first compactor drum 106 also includes a second support bracket 140. A lower portion of the second support bracket 140 is coupled to the second support plate 130, whereas an upper portion of the second support bracket 140 is coupled to the frame 102. Thus, the second support bracket 140 and the second support plate 130 together couple the second side 132 of the first compactor drum 106 with the frame 102.

The first compactor drum 106 includes a vibration system 142 for generating the vibrations in the first compactor drum 106. In the illustrated embodiment, the vibration system 142 is embodied as an oscillatory vibration system. Alternatively, the vibration system 142 may embody any conventional vibration system, without limiting the scope of the present disclosure. The vibration system 142 includes a vibration motor (not shown). The vibration motor is coupled to the second support plate 130. The vibration motor may be embodied as a hydraulic motor, without any limitations. An input shaft 144 (shown in FIG. 3) is coupled to the vibration motor. Further, a bearing assembly (not shown) is associated with the vibration system 142. The bearing assembly supports the first compactor drum 106 enabling independent rotation of the first compactor drum 106 about the vibration system 142.

The vibration system 142 includes a central support structure 146. The central support structure 146 is disposed between the first and second support plates 118, 130. The central support structure 146 is embodied as a circular plate that is fixedly mounted within the drum shell 114. The central support structure 146 is welded to the inner surface of the drum shell 114. In one example, the central support structure 146 is made of a metal that is flexible in nature.

Figure 3:
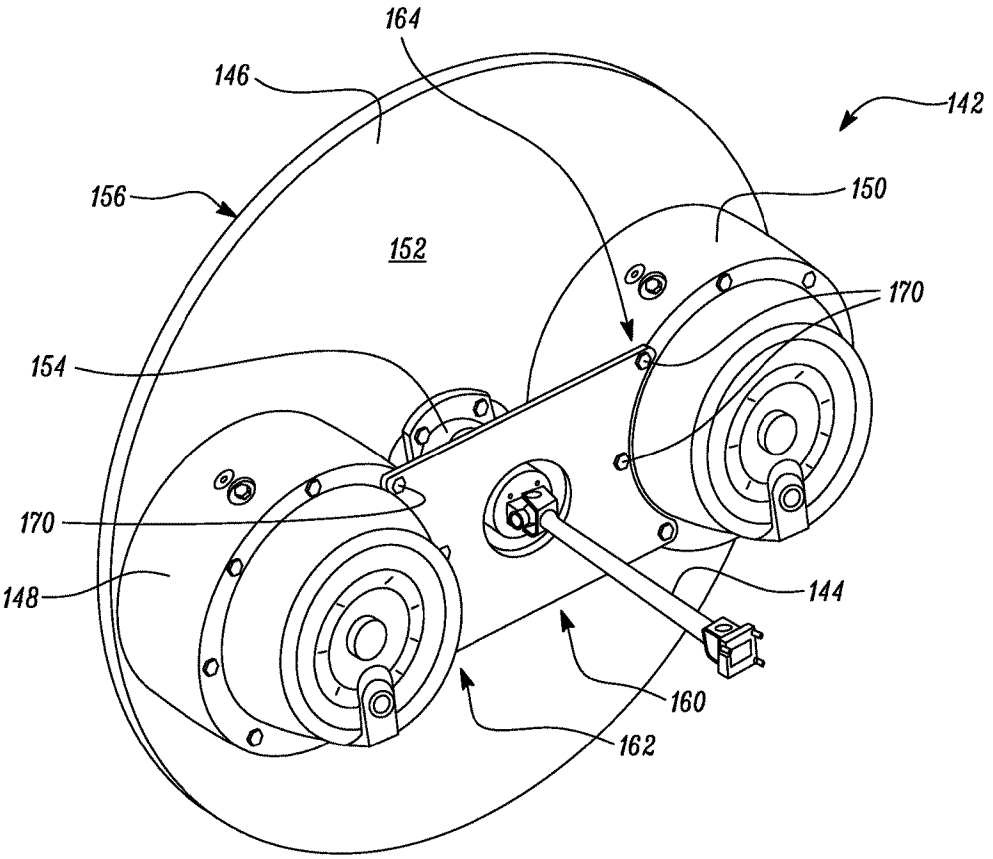
FIG. 3 is a perspective view of a vibration system associated with the compactor drum of FIG. 2.

Referring now to FIG. 3, the central support structure 146 supports a first vibratory exciter 148 and a second vibratory exciter 150. The first and second vibratory exciters 148, 150 are mounted on a first surface 152 of the central support structure 146. The first and second vibratory exciters 148, 150 are embodied as eccentric masses. The first and second vibratory exciters 148, 150 are longitudinally spaced apart from each other. The first and second vibratory exciters 148, 150 generate the vibrations in the first compactor drum 106, based on an activation of the vibration motor. More particularly, the input shaft 144 of the vibration system 142 is coupled to a drive shaft 154 of the vibration system 142. The drive shaft 154 is in turn coupled to a gear train (not shown). The gear train is mounted on a second surface 156 of the central support structure 146, and is provided within a cover 158 (shown in FIG. 2). When the vibration motor is activated, the drive shaft 154, the input shaft 144, and the gear train together drive or rotate the first and second vibratory exciters 148, 150 for generating the vibrations in the first compactor drum 106.

As the first compactor drum 106 vibrates, the central support structure 146 is subjected to fatigue at a weld junction where the central support structure 146 is coupled to the drum shell 114. The present disclosure relates to a stabilizer element 160 for enhancing a stability of the central support structure 146 in order to reduce vibrations of the central support structure 146.

The stabilizer element 160 extends between the first and second vibratory exciters 148, 150, and is parallel to the central support structure 146. More particularly, a first end 162 of the stabilizer element 160 is coupled to the first vibratory exciter 148. Whereas, a second end 164 of the stabilizer element 160 is coupled to the second vibratory exciter 150. In one example, the stabilizer element 160 is coupled to each of the first and second vibratory exciters 148, 150 using mechanical fasteners 170. More particularly, the first and second ends 162, 164 of the stabilizer element 160 include a number of through-holes 166, 168, respectively (shown in FIG. 4). The through-holes 166, 168 are aligned with a number of apertures (not shown) provided in the vibratory exciters 148, 150 for receiving the mechanical fasteners 170. The mechanical fasteners 170 may include any one of a bolt, pin, screw, rivet, and the like, without any limitations.

Figure 4:
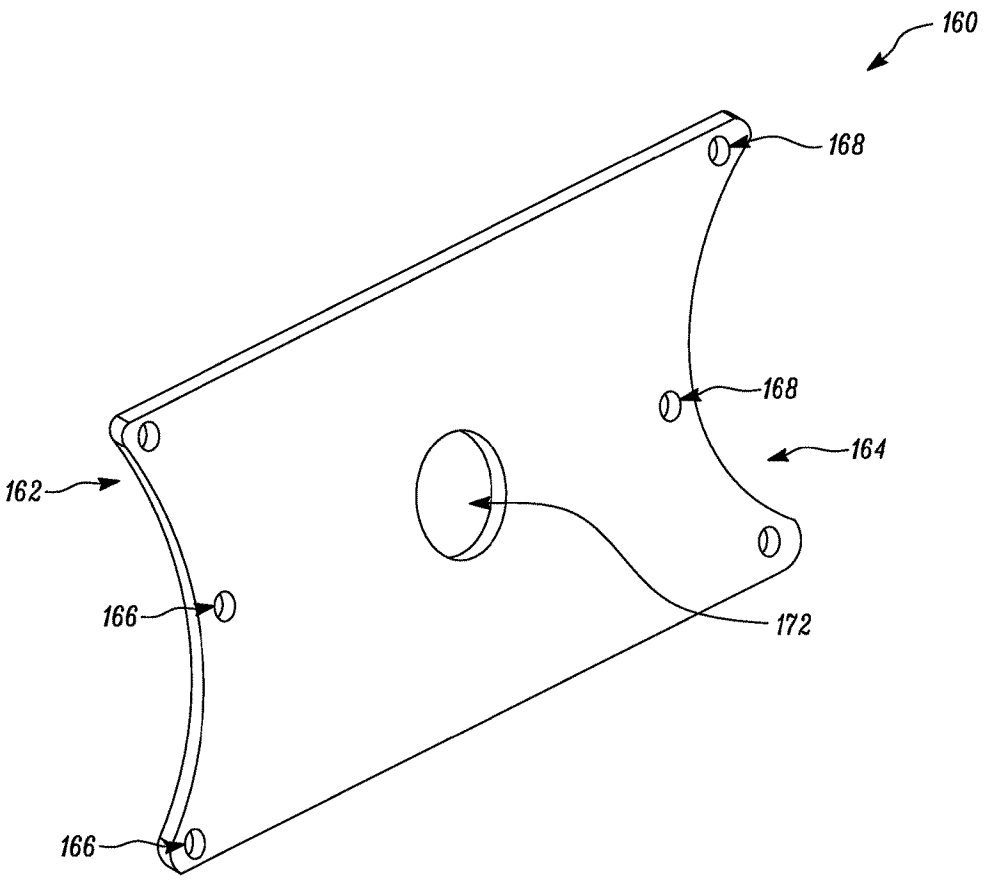
FIG. 4 is a perspective view of a stabilizer element associated with the vibration system, according to one embodiment of the present disclosure.

Referring now to FIG. 4, the stabilizer element 160 includes a generally rectangular shape. However, a shape of the stabilizer element 160 may vary, based on system requirements. Further, the first and second ends 162, 164 of the stabilizer element 160 include a modaly tuned shape. In the illustrated example, the first and second ends 162, 164 are arcuate in shape for confirming with an outer profile of the first and second vibratory exciters 148, 150. However, it should be noted that the shape of the first and second ends 162, 164 may vary based on the outer profile of the first and second vibratory exciters 148, 150. The stabilizer element 160 also includes a central through-hole 172. The through-hole 172 allows passage of the input shaft 144 (see FIG. 3) therethrough for connection of the input shaft 144 with the drive shaft 154 (see FIG. 3), and to avoid interference of the stabilizer element 160 in the operation of the vibration system 142.

Further, a thickness of the stabilizer element 160 is decided based on a behavior of the vibration system 142, and more particularly, based on second harmonics of the vibration system 142. In one example, the thickness is based on a maximum frequency of vibrations that the central support structure 146 may be subjected to. If the stabilizer element 160 has a thickness lower than an optimal thickness, the stabilizer element 160 may not provide desired stiffness to the central support structure 146. Further, if the stabilizer element 160 has a thickness that is greater than the optimal thickness, the stabilizer element 160 might make the vibration system 142 bulky.

In one example, the stabilizer element 160 is made of a semi-rigid material that exhibits high stiffness. For example, the stabilizer element 160 is made of metal such as steel. Alternatively, the stabilizer element 160 is made of aluminum, or any other metal that exhibits high stiffness, without any limitations. The stabilizer element 160 of the present disclosure can be manufactured by any additive manufacturing process, such as 3D printing, casting, or any subtractive manufacturing process, such as machining, without any limitations.

It should be noted that the vibration system associated with the second compactor drum 108 may also include a stabilizer element that is similar in design and function to the stabilizer element 160 described in relation to FIGS. 3 and 4, without any limitations.

INDUSTRIAL APPLICABILITY

The present disclosure relates to the stabilizer element 160 associated with the vibration system 142. The stabilizer element 160 is simple in design and manufacturing, cost effective, and easy to install. Further, the stabilizer element 160 can be easily retrofitted to any existing machine. The stabilizer element 160 increases the stiffness of the components of the first compactor drum 106, and more particularly the central support structure 146. As the central support structure 146 is subjected to low vibrations, fatigue propagation at a weld joint where the central support structure 146 is secured to the drum shell 114 is reduced. The stabilizer element 160 also reduces the possibility of structural failures of the components of the first compactor drum 106. Overall, the stabilizer element 160 reduces a possibility of early breakdown of the components of the first compactor drum 106.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A vibration system for a compactor drum, the vibration system comprising:
   - a central support structure fixedly mounted within the compactor drum;
   - a first vibratory exciter coupled to the central support structure;
   - a second vibratory exciter coupled to the central support structure, wherein the second vibratory exciter is longitudinally spaced apart from the first vibratory exciter; and
   - a stabilizer element coupled to, and extending between, the first and second vibratory exciters, wherein the stabilizer element is parallel to the central support structure.

2. The vibration system of claim 1, wherein a first end of the stabilizer element is coupled to the first vibratory exciter and a second end of the stabilizer element is coupled to the second vibratory exciter.

3. The vibration system of claim 2, wherein the stabilizer element is coupled to each of the first and second vibratory exciters using mechanical fasteners.

4. The vibration system of claim 2, wherein a shape of the first and second ends of the stabilizer element is based on an outer profile of the first and second vibratory exciters.

5. The vibration system of claim 3, wherein the first and second ends of the stabilizer element includes a modaly tuned shape.

6. The vibration system of claim 1, wherein the stabilizer element is made of steel.

7. The vibration system of claim 6, wherein the stabilizer element is made of a semi-rigid material, such as, aluminum.

8. A compactor drum for a compaction machine, the compactor drum comprising:
   - a drum shell;
   - a first support plate fixedly mounted within the drum shell, wherein the first support plate is adapted to couple a first side of the compactor drum with a frame of the compaction machine;
   - a second support plate fixedly mounted within the drum shell, the second support plate being spaced apart from the first support plate, wherein the second support plate is adapted to couple a second side of the compactor drum with the frame of the compaction machine; and
   - a vibration system for generating vibrations in the compactor drum, the vibration system comprising:
     - a central support structure fixedly mounted within the drum shell;
     - a first vibratory exciter coupled to the central support structure;
     - a second vibratory exciter coupled to the central support structure, wherein the second vibratory exciter is longitudinally spaced apart from the first vibratory exciter; and a stabilizer element coupled to, and extending between, the first and second vibratory exciters, wherein the stabilizer element is parallel to the central support structure.

9. The compactor drum of claim 8, wherein a first end of the stabilizer element is coupled to the first vibratory exciter and a second end of the stabilizer element is coupled to the second vibratory exciter.

10. The compactor drum of claim 9, wherein the stabilizer element is coupled to each of the first and second vibratory exciters using mechanical fasteners.

11. The compactor drum of claim 9, wherein a shape of the first and second ends of the stabilizer element is based on an outer profile of the first and second vibratory exciters.

12. The compactor drum of claim 11, wherein the first and second ends of the stabilizer element includes a modaly tuned shape.

13. The compactor drum of claim 8, wherein the stabilizer element is made of steel.

14. The compactor drum of claim 13, wherein the stabilizer element is made of a semi-rigid material, such as, aluminum.

15. A compaction machine comprising:

a frame; and at least one compactor drum coupled to the compaction machine; wherein the at least one compactor drum includes a drum shell and a vibration system, the vibration system comprising:

a central support structure fixedly mounted within the drum shell;

a first vibratory exciter coupled to the central support structure;

a second vibratory exciter coupled to the central support structure, wherein the second vibratory exciter is longitudinally spaced apart from the first vibratory exciter; and a stabilizer element coupled to, and extending between, the first and second vibratory exciters, wherein the stabilizer element is parallel to the central support structure.

16. The compaction machine of claim 15, wherein a first end of the stabilizer element is coupled to the first vibratory exciter and a second end of the stabilizer element is coupled to the second vibratory exciter.

17. The compaction machine of claim 16, wherein the stabilizer element is coupled to each of the first and second vibratory exciters using mechanical fasteners.

18. The compaction machine of claim 16, wherein a shape of the first and second ends of the stabilizer element is based on an outer profile of the first and second vibratory exciters.

19. The compaction machine of claim 18, wherein the first and second ends of the stabilizer element includes a modaly tuned shape.

20. The compaction machine of claim 15, wherein the stabilizer element is made of steel.

* * * * *